US007140303B2

(12) United States Patent
Fortuna

(10) Patent No.: US 7,140,303 B2
(45) Date of Patent: Nov. 28, 2006

(54) LOCK ASSEMBLY FOR A GATE ASSEMBLY OF A RAILROAD HOPPER CAR

(75) Inventor: Rudolph S. Fortuna, Oak Creek, WI (US)

(73) Assignee: Powerbrace Corporation, Kenosha, WI (US)

( * ) Notice: Subject to any disclaimer, the term of this patent is extended or adjusted under 35 U.S.C. 154(b) by 156 days.

(21) Appl. No.: 10/925,398

(22) Filed: Aug. 25, 2004

(65) Prior Publication Data

US 2006/0042499 A1 Mar. 2, 2006

(51) Int. Cl.
*B61D 7/00* (2006.01)

(52) U.S. Cl. ..... 105/308.1; 105/308.2; 105/282.1; 105/282.3

(58) Field of Classification Search ..... 292/44, 292/45, 48, 56, 194, 230, 270, 274, 297, 292/304, DIG. 22, 238; 105/308.1, 309, 105/310.1, 310.2, 282.1, 282.3, 308.2
See application file for complete search history.

(56) References Cited

U.S. PATENT DOCUMENTS

| | | | | |
|---|---|---|---|---|
| 3,446,538 | A | | 5/1969 | Danielson |
| 3,650,567 | A | | 3/1972 | Danielson |
| 3,683,820 | A | | 8/1972 | Floehr |
| 3,843,204 | A | | 10/1974 | Fischer |
| 3,893,398 | A | | 7/1975 | Fischer |
| 3,956,996 | A | | 5/1976 | Fischer |
| 4,094,254 | A | | 6/1978 | Koranda |
| 4,099,468 | A | * | 7/1978 | Adler ..... 292/238 |
| 4,256,042 | A | | 3/1981 | Fischer |
| 4,262,603 | A | | 4/1981 | Morse |
| 5,584,251 | A | | 12/1996 | Lucas |
| 5,671,684 | A | | 9/1997 | Lucas |
| RE35,925 | E | | 10/1998 | Dohr et al. |
| 5,829,359 | A | | 11/1998 | Dohr et al. |

* cited by examiner

*Primary Examiner*—Mark T. Le
(74) *Attorney, Agent, or Firm*—Jiohn W. Harbst

(57) ABSTRACT

A lock assembly kit including components capable of being assembled to a railcar gate assembly including a frame defining a discharge opening and having a pair of generally parallel, free ended and stationary rigid racks extending from one end of the frame away from said discharge opening, a gate mounted on said frame for sliding movements along a predetermined path of travel between open and closed positions and relative to the discharge opening, and a drive mechanism for moving and movable with the gate between the open and closed positions thereof. The lock assembly kit includes a control shaft mounted adjacent the free ends of the racks and which is provided with operating handles radially extending from and secured to the control shaft. A stop mounted for movement between locking and unlocking conditions. The stop extends into the path of travel of the gate when in the locking condition thereby operably preventing inadvertent movement of the gate from the closed position toward the open position. The stop is movable with the control shaft. The lock assembly kit further includes a spring biased latching mechanism for positively maintaining the stop in the unlocking condition until after the gate moves a predetermined distance from the closed position.

4 Claims, 5 Drawing Sheets

FIG. 2
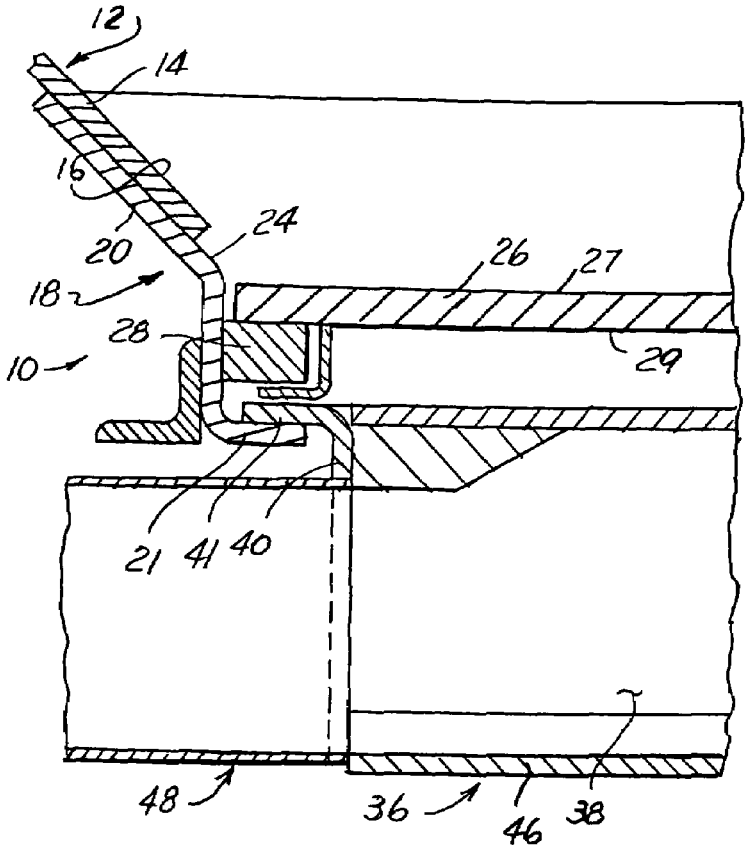
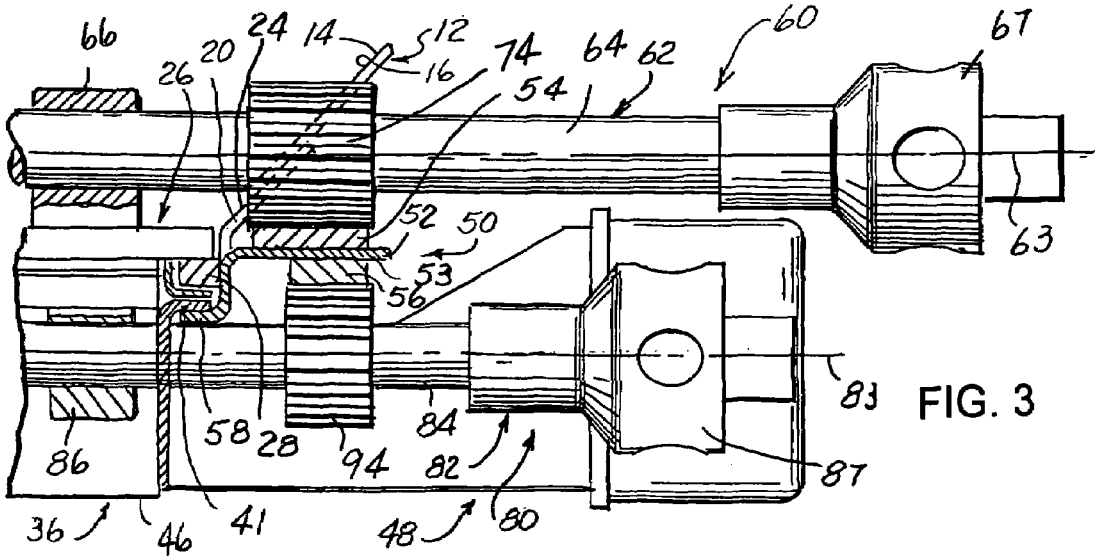
FIG. 3

FIG. 6
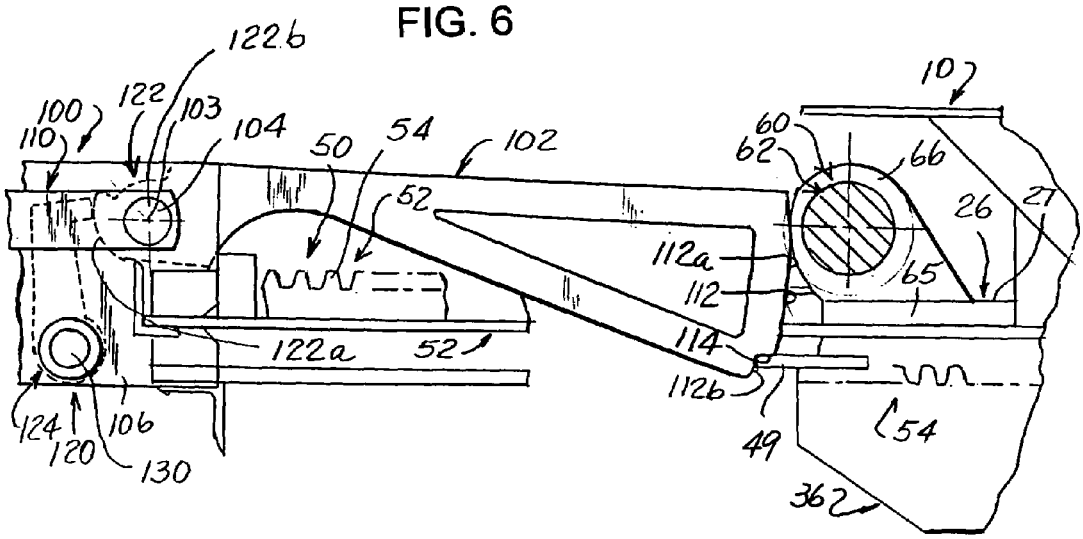
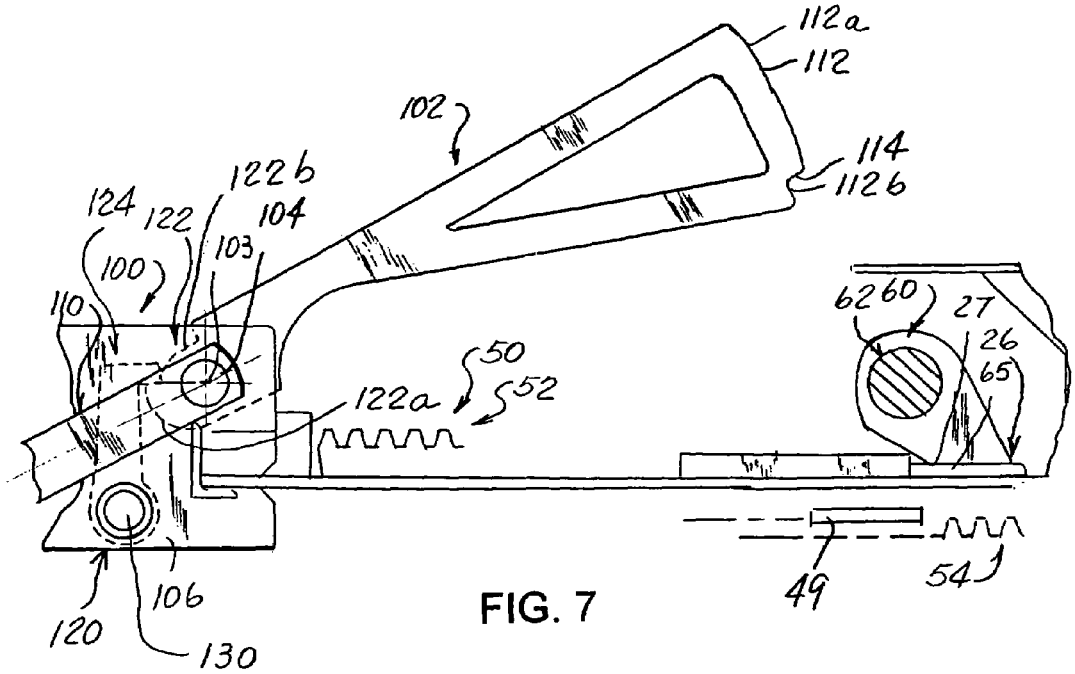
FIG. 7

LOCK ASSEMBLY FOR A GATE ASSEMBLY OF A RAILROAD HOPPER CAR

FIELD OF THE INVENTION

The present invention generally relates to a gate assembly for a railroad hopper car and more particularly, to a lock assembly for inhibiting inadvertent movement of one or more sliding elements of the gate assembly toward an open position from a closed position.

SUMMARY OF THE INVENTION

Railroad hopper car gate assemblies typically include a gate which slides relative to a frame of the gate assembly between a closed position and an open position in response to operation of a drive mechanism. Such railroad hopper cars are designed to carry various forms of lading including grain, cement, and a myriad of other granular products. As will be appreciated, the rolling weight of such cars, even when empty, is substantial As is known, railroad hopper cars are subjected to numerous impacts, some of which can be quite severe. For example, when a railroad car moves down a hump in a classification yard, it likely will impact with other cars on the track ahead of it and the impact can be exceeding forceful. While shock absorbers are built into coupling units on the cars, severe shock loads are nevertheless transferred to the body of the cars and its contents. Such shock loads can and often do affect the position of the slide gate relative to the frame of the gate assembly largely as a result of inertia. Such inertia will often cause the gate to inadvertently move from a closed position to an open position. As will be appreciated, even a relatively slight movement of the gate from the closed position toward an open position can result in contamination and/or loss of the lading being transported within the car.

Accordingly, most railroad hopper cars are provided with some kind of locking device for holding the gate in the closed position relative to the frame. Such locking devices come in a myriad of different forms. In the majority of styles, however, the locking device moves into and out of the path of travel of the gate.

Speed is key factor when a railroad hopper car is to be emptied. That is, when the car is to be unloaded or emptied, a relatively high speed torque driver is coupled to the drive mechanism on the gate assembly and the gate is moved in a rapid sliding motion from the closed position to the open position. Prior to moving the railroad hopper car into position for unloading, the movable locking device needs to be manually removed from the path of travel of the gate. Because the opening on most gate assemblies is considerably narrower than the width of most railroad hopper cars, however, to remove locking device from the path of travel of the gate usually requires a person to climb under the car and physically move the locking device from a locking condition to an unlocking condition to allow for sliding movement of the gate toward the open position. While accepted for years, considerable concern and attention has recently been directed toward requiring an operator to move beneath the car to unlock the locking device.

On occasion, the distance between the railcar location when the locking device is manually moved from the locked to the unlocked position and the car location where it is to be emptied or unloaded can be lengthy. Moreover, it is not unusual, for the car to be frequently bumped as it moves between locations. For these and other reasons, and although unintentional, the locking device frequently returns from the unlocked condition to the locked condition. With the car unloading operator believing the locking device to be in an unlocked condition, a high speed toque driver is engaged with the drive mechanism on the gate and the gate is forcibly propelled toward the open position with a relatively high speed. When the locking device has inadvertently returned to a locked condition, the locking device will either inhibit movement of the gate, thus, adding significant time to the unloading operation, or will be simply broken off by the brute force of the torque driver used to open the gate. In either event, damage to the gate assembly results.

To further exacerbate the problem of unloading the railcar, some gate assemblies include two slidably movable elements. One slidable element comprises the gate. The other slidable element, however, can take different forms. In one form, the second slidable element comprises a protective plate slidably movable between open and closed positions for inhibiting contamination of either the underside of the gate or a plenum chamber formed by the frame of the gate assembly beneath an underside of the gate. In another form, the other slidable element of the gate assembly comprises a pan assembly allowing for pneumatic discharge of materials from the hopper car.

As will be appreciated, the second slidable element on the gate assembly is likewise susceptible to inadvertent movements from a closed position and toward an open position. Accordingly, another form of locking mechanism is needed for inhibiting such shifting movements of the second element or pan assembly. The required addition of a second locking mechanism is also susceptible to all those problems mentioned above regarding the locking mechanism for inhibiting shifting movements of the gate while increasing the cost of the gate assembly.

Thus, there is a continuing need and desire for a lock assembly for a railcar gate assembly which inhibits movement of the gate relative to the frame and toward an open position, is positively maintained in an unlocked condition, while conjointly serving to inhibit shifting movements of a second element on the gate assembly toward an open position.

SUMMARY OF THE INVENTION

In view of the above, and in accordance with one aspect, there is provided a railroad hopper car discharge gate assembly defining a discharge opening, with the gate assembly including a frame structure having a predetermined width and a gate disposed for endwise sliding movements along a predetermined path of travel. The gate assembly further includes a drive mechanism for positively moving the gate between open and closed positions. According to the present invention, a lock assembly is provided and includes a locking member mounted for movement between locking and unlocking conditions. In the locking condition, the locking member extends into the path of travel of the gate to operably prevent inadvertent movement of the gate from the closed position toward the open position. In the unlocking condition, the locking member allows the gate to be moved toward the open position from the closed position. The lock assembly also includes a mechanism for positively maintaining the locking member in the unlocking condition until after the gate moves a predetermined distance from the closed position.

In one form, the gate assembly further includes a rack formation, and wherein the drive mechanism includes a rotatable drive shaft operably connected to the gate. A pair of pinion gears mounted on the drive shaft are arranged for intermeshing relation with the rack formation such that rotation of the drive shaft moves the gate along its predetermined path of travel. Preferably, operating handles are provided at opposed ends of the rotatable drive shaft whereby allowing the gate to be selectively and slidably moved between positions from either side of said hopper car.

In one embodiment, the lock assembly further includes a control shaft mounted toward a free end of the rack formation for rotation about a fixed axis extending generally parallel to an axis of the drive mechanism. Preferably, the control shaft has a width between opposed ends greater than the predetermined width of the gate. Moreover, the locking member radially extends from and is secured for rotation with the control shaft. The locking member extends into the path of travel of the gate when in the locked condition to block movement of the gate toward the open position. Preferably, the axis about which the control shaft rotates is disposed above an upper surface of the gate to enhance visualization of the relationship between the locking member and the gate. To facilitate operation of the lock assembly, handles are preferably disposed adjacent opposed ends of the control shaft for moving the locking member into the unlocking condition.

In a preferred form, the mechanism for positively maintaining the locking member in the unlocking condition includes a cam secured to and for rotation with the control shaft and a follower latch. The periphery of the cam defines a plurality of portions, such that when the locking member is in the locking condition and in one rotational position of the cam, the follower latch is operably disengaged from the cam and, in response to the locking member being moved to the unlocking condition, the follower latch operably engages with another portion of the cam whereby preventing the locking member from returning to the locking condition. Preferably, the mechanism for positively maintaining the locking member in the unlocked condition further includes a spring for biasing the follower latch into operable engagement with the cam. In a most preferred form, a tamper seal arrangement is provided in combination with the lock assembly for visually indicating whether the locking member has been moved from the locking condition.

According to another aspect, there is provided a railroad hopper car discharge gate assembly including a rigid frame assembly defining a discharge opening and having a predetermined width. A first element is mounted on the frame assembly for sliding movements along a predetermined path of travel between a first position, beneath the discharge opening, and a second position, away from the discharge opening. A first operating shaft assembly moves the first element between the first and second positions. A second element is also mounted on the frame assembly in vertically spaced relation beneath the first element for sliding movements along a predetermined path of travel between a first position, beneath the discharge opening, and a second position, away from the discharge opening. A second operating shaft assembly moves the second element between the first and second positions. In accordance with the present invention, a lock assembly, including a locking member, movable between locking and unlocking conditions, is provided for inhibiting inadvertent shifting movements of either the first or second elements toward their second positions. When in a locking condition, a portion of the locking member extends into the path of travel of each of the first and second elements so as to prevent either the elements from inadvertently moving toward their open positions. When in the unlocking condition, the locking member is positioned to allow the first or second element to move toward their second position. The lock assembly further includes a mechanism for positively maintaining the locking member in the unlocking condition until after at least one of the first and second elements move a predetermined distance from the first position toward the second position.

According to this aspect, and upon rotation, the first operating shaft assembly moves with the first element between the first and second positions. Similarly, and according to this aspect, and upon rotation, the second operating shaft assembly moves with the second element between the first and second positions.

In one form, a rack formation extends from one end of the frame assembly and is provided with racks on opposed vertical sides thereof. The first operating shaft assembly is operably connected to the first element and has a pair of laterally spaced pinion gears that intermesh with the rack formation such that rotation of the first operating shaft assembly positively moves the first element along its predetermined path of travel. Similarly, the second operating shaft assembly is operably connected to the second element and has a pair of laterally spaced pinion gears that intermesh with the rack formation such that rotation of the second operating shaft assembly positively moves the second element along its predetermined path of travel.

Preferably, the lock assembly includes a control shaft mounted toward a free end of the rack formation for rotation about an axis extending generally parallel to an axis of the first operating shaft assembly. In a preferred form, the lock assembly further includes a pair of handles secured toward opposed ends of the control shaft such that the lateral spacing between the handles is greater than the width of the frame assembly whereby facilitating movement of the locking member into the unlocking condition from either side of the gate assembly In a preferred form, the locking member radially extends from and is secured for rotation with the control shaft. The locking member preferably defines a surface with first and second portions arranged, respectively, in the path of travel of the first and second elements when the first and second elements are arranged in their first positions. In a preferred embodiment, the axis of the control shaft is disposed above an upper surface of the first element to enhance visualization of the relationship between the locking member and the first element.

The mechanism of said lock assembly for positively maintaining the locking member in said unlocked condition includes a cam secured to and for rotation with the control shaft and a follower latch. A periphery of the cam defines a plurality of portions, and, with the locking member being in the locking condition and in one rotational position of the cam, the follower latch is operably disengaged from the cam and, in response to the locking member being moved to the unlocking condition, the follower latch operably engages with another portion of the cam whereby preventing the lock assembly from returning to the locking condition.

Preferably, the first element of the gate assembly is configured with an extension projecting from one end thereof and extending toward and in alignment with the follower latch. As such, and after the first element of the gate assembly is moved a predetermined distance toward the second position, the extension operably disengages the follower latch from the cam, thus, allowing the locking member to return toward its locked condition. In a most preferred form, a spring biases the follower latch into operable engagement with the periphery of the cam.

In one form, the first element of the gate assembly is designed as a discharge gate slidably movable along a generally horizontal path of travel relative to the frame assembly. Similarly, the second element of the gate assembly is preferably designed as a pan assembly defining an open top vacuum chamber. The pan assembly is slidably movable along a generally horizontal path of travel relative to the frame assembly. Preferably, a tamper seal arrangement, including a breakable tamper seal, is provided in combination with the lock assembly for visually indicating whether said locking member has been moved from the locking condition.

According to another aspect, there is provided a discharge gate assembly for a railroad hopper car including a four sided rigid frame structure defining a discharge opening. The frame structure has a predetermined width and a pair of generally parallel, free ended racks extending away from the discharge opening in only one direction. A discharge gate is supported on said frame structure for generally linear sliding movements along a predetermined path of travel and in opposed directions, with the discharge gate extending across the discharge opening when in a closed position, and is movable toward an open position. A vacuum pan assembly is also carried on the frame structure beneath the discharge gate for generally linear sliding movements along a predetermined path of travel, with the pan assembly extending across the discharge opening when in a closed position, and movable toward an open position. A first drive mechanism, for moving the gate, is operably carried by and movable with the gate. A second drive mechanism, for moving the pan assembly, is operably carried by and movable with the pan assembly. A lock assembly including a displacable stop, mounted for movement about a pivot axis disposed rearwardly of the first axis of said first operating shaft assembly at an elevation above the predetermined path of travel of said discharge gate, is also provided. When the discharge gate and pan assembly are in their closed positions, the stop extends downward and forward relative to the stop's pivot axis and into the path of travel of both the discharge gate and pan assembly so as to prevent substantial linear movement of either toward their open position.

The first drive mechanism also includes a pair of pinions mounted on the first operating shaft assembly. The pinions are arranged in intermeshing relationship relative to rack structure extending from the frame structure. As such, and upon rotation of the first operating shaft assembly, the gate slidable moves. Preferably, the first operating shaft assembly is journaled for rotation toward one edge of the discharge gate.

In a preferred embodiment, the second drive mechanism includes another pair of pinions mounted on the second operating shaft assembly. The pinions of the second drive mechanism are also arranged in intermeshing relationship with the rack structure for moving the pan assembly in response to rotation of a second operating shaft assembly.

The lock assembly for the gate assembly further includes an elongated control shaft rotatably supported at opposite ends adjacent a free end of the rack structure. The control shaft defines the pivot axis about which the stop moves and to which the stop is connected for movement therewith. Preferably, the control shaft has a width between opposed ends greater than the predetermined width of the frame structure. In a preferred form, the control shaft, toward opposed ends thereof, is provided with handles for facilitating removal of the stop from the path of travel of both the discharge gate and assembly and from either side of the hopper car.

In one form, the lock assembly further includes a mechanism for releasably holding the stop in a position removed from the path of travel of either the discharge gate or the pan assembly until after the discharge gate moves a predetermined distance from the closed position toward the open position. The mechanism for releasably holding the stop in a position removed from the path of travel of the discharge gate or pan assembly preferably includes a cam, secured for rotation with the control shaft, and a follower latch, with a periphery of the cam defining a plurality of portions, and with the stop being positioned to block movement of the discharge gate and pan assembly and in one rotational position of the cam. In one position, the follower latch is operably disengaged from the cam and, in response to displacement of the stop to a position whereat the stop is removed from the path of travel of the gate or pan assembly, the follower latch operably engages with another portion of the cam whereby preventing the stop from returning to a position to block movement of the discharge gate and the pan assembly.

In one form, the discharge gate is configured with an extension projecting from one end thereof and extending toward and in general alignment with the follower latch for operably disengaging the follower latch from the cam after the discharge gate moves a predetermined distance toward the open position. Preferably, the mechanism for releasably maintaining the stop in the unlocked condition further includes a spring for biasing the follower latch into operable engagement with the periphery of said cam. Additionally, a tamper seal arrangement, including a breakable tamper seal, is preferably provided in combination with the lock assembly for visually indicating whether the stop has been displaced from blocking movement of the discharge gate and pan assembly.

According to another aspect, there is provided a lock assembly kit having components capable of being assembled in the field to a railroad car gate assembly including a rigid frame defining a discharge opening and having a pair of generally parallel, free ended and stationary rigid racks extending from one end of the frame, a gate mounted on the frame for sliding movements along a predetermined path of travel between open and closed positions and relative to the discharge opening, and a drive mechanism for moving and movable with the gate between the open and closed positions thereof. The lock assembly kit includes a control shaft mounted for rotation about a fixed axis disposed adjacent the free ends of the racks. The fixed axis of the control shaft is preferably disposed above an upper surface of the gate, and with the control shaft having operating handles radially extending from and secured to opposed ends thereof A stop is secured axially intermediate the opposed ends of the control shaft for rotation therewith. A portion of the stop extends into the path of travel of the gate when the stop is in an locked condition. A mechanism is arranged adjacent the control shaft for positively holding the stop in an unlocked condition. In the unlocked condition, the stop is removed from the path of travel of the gate, until after the gate has been moved a predetermined distance toward the open position.

A primary feature of the present invention relates to providing a lock assembly for a sliding gate assembly of a railroad hopper car which can be manually operated without requiring an operator to have to reach far under the railcar to disengage the lock assembly, thus, enhancing access to the lock assembly.

Another feature of the present invention relates to providing a lock assembly for a sliding gate assembly of a railroad hopper car which can be conditioned to a non-locking position from either side of the railcar.

Still another feature of the present invention relates to providing a single lock assembly which can be used on railcars having gate assemblies which are configured for either pneumatic and gravitational discharge.

Yet another feature of the present invention relates to providing a kit which can be retrofitted to gate assemblies on existing railcars.

Still a further feature of the present invention relates to providing a lock assembly for a railroad hopper car gate assembly capable of yielding all of he above features while maintaining simplicity in design at a relatively inexpensive cost.

These and other aims, features and advantages of the present invention will become more readily apparent from the following detailed description, the drawings and the appended claims.

DESCRIPTION OF THE DRAWINGS

FIG. 2 is a fragmentary longitudinal sectional view of a preferred form of discharge gate assembly with first and second elements of the gate assembly each being shown in their closed position;

FIG. 3 is a fragmentary vertical transverse section of the gate assembly of the present invention;

FIG. 6 is a side view of the lock assembly mounted to the gate assembly and showing a stop of the lock assembly in a locking condition;

FIG. 7 is a view similar to FIG. 6 but showing the stop of the lock assembly after being moved to an unlocking condition;

DESCRIPTION OF THE INVENTION

Figure 1:
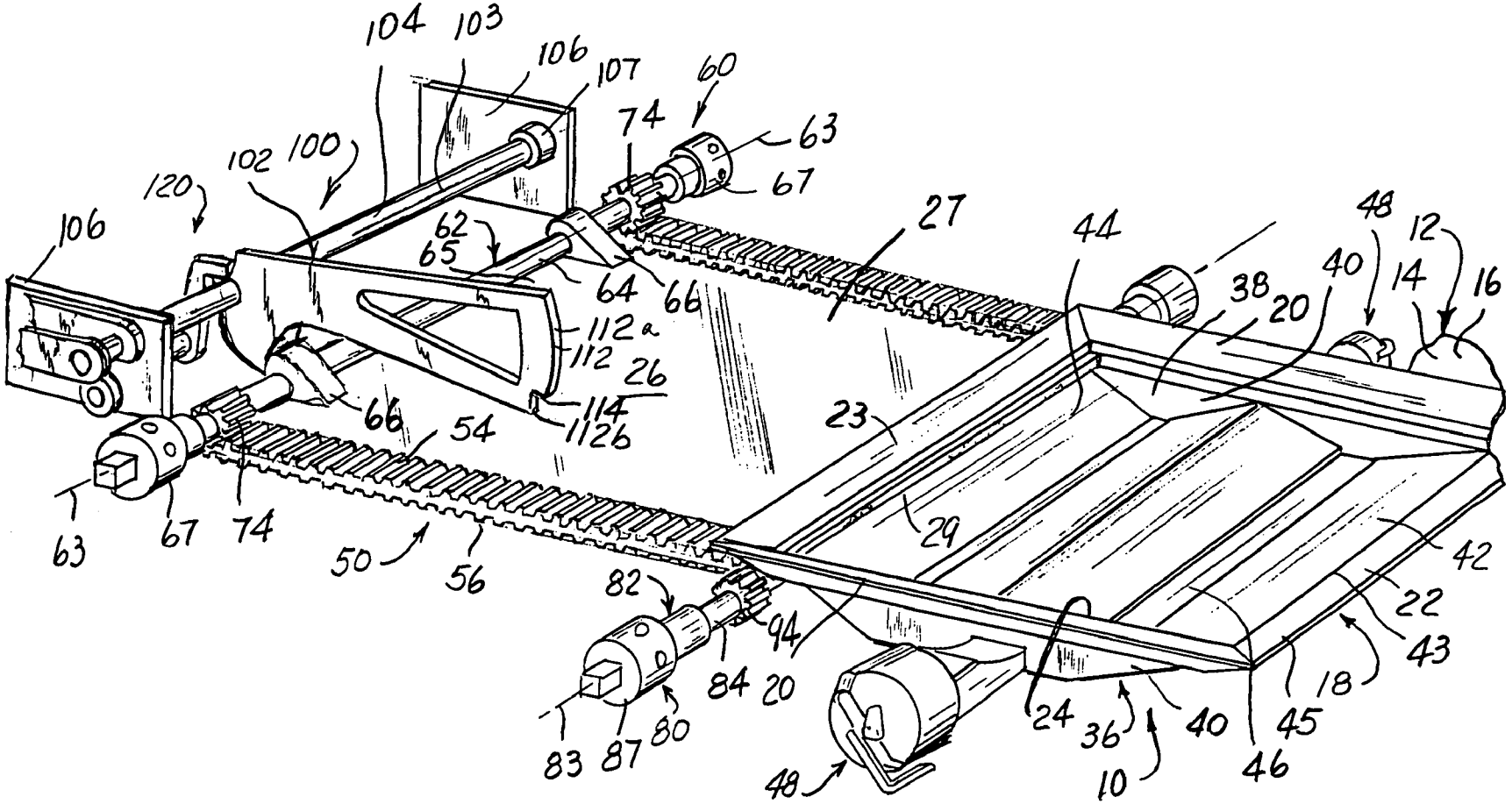
FIG. 1 is a perspective view of one form of lock assembly for a railroad hopper car gate assembly embodying principals of the present invention.

While the present invention is susceptible of embodiment in multiple forms, there is shown in the drawings and will hereinafter be described a preferred embodiment of the invention, with the understanding the present disclosure sets forth an exemplification of the invention which is not intended to limit the invention to the specific embodiment illustrated and described.

Referring now to the drawings, wherein like reference numerals indicate like parts throughout the several views, there shown a manually operated gate assembly, generally indicated by reference numeral 10. As is known in the art, gate assembly 10 is securable to a conventional railroad hopper car 12. The railroad hopper car 12 typically includes inner and outer sidewalls which meet with oppositely sloping endwalls to complete four sides of a hopper 14 defining a hopper opening 16 between the bottom edges of the walls.

The discharge gate assembly 10 generally includes a rigid, frame structure 18 including spaced sidewalls 20, a front wall 22, and an end wall 23 rigidly secured together and defining a discharge opening 24. A first predetermined transverse distance is provided between the sidewalls 20 of the frame structure 18. As will be appreciated, and after gate assembly 10 is fitted and secured toward the lower edges of hopper 14 by any suitable means such as welding, bolting or riveting, the discharge opening 24 of the gate assembly 10 is arranged in registry with the hopper opening 16 on the respective hopper 14. In a preferred form, frame structure 18 is configured to allow for convenient attachment of conventional unloading boots which are necessary for sanitary unloading of foodstuffs or other contaminable lading under gravity discharge conditions Gate assembly 10 further includes a first element or slide gate 26 defining generally parallel upper and lower surfaces 27 and 29 (FIG. 2), respectively. Gate 26 is movable along a predetermined path of travel between a closed position and an open position. In the closed position, element 26 extends across the discharge opening 24 in the gate assembly 10 to inhibit material from flowing therethrough. In the embodiment shown in FIG. 2, frame structure 18 includes elongated gate supporting rails 28 secured to and extending longitudinally along the sidewalls 20 to provide ways on which element 26 can slide along a predetermined path of travel. In the open position, element 26 is removed from beneath the hopper opening 16.

In the illustrated embodiment, gate assembly 10 further includes a second element or pan assembly 36 which is vertically arranged beneath the first element 26 and, in the illustrated embodiment, defines an open top plenum or vacuum chamber 38 which promotes use of the gate assembly 10 in combination with food grade materials. Like element 26, the second element 36 is movable along a predetermined path of travel between a closed position, wherein element 36 underlies the discharge opening 24 of the gate assembly 10 and an open position, wherein element 36 is removed from a position underlying the discharge opening 24 of gate assembly 10. It should be appreciated, however, the second element 36 on the gate assembly 10 could be configured other than as a pan assembly without detracting or departing from the sprit and scope of the present invention. For example, the teachings of the present invention equally apply to a gate assembly having a second element 36 configured as a plate cover for protecting the underside of the gate 26 and the plenum defined by frame 18 from contaminants.

Figure 4:
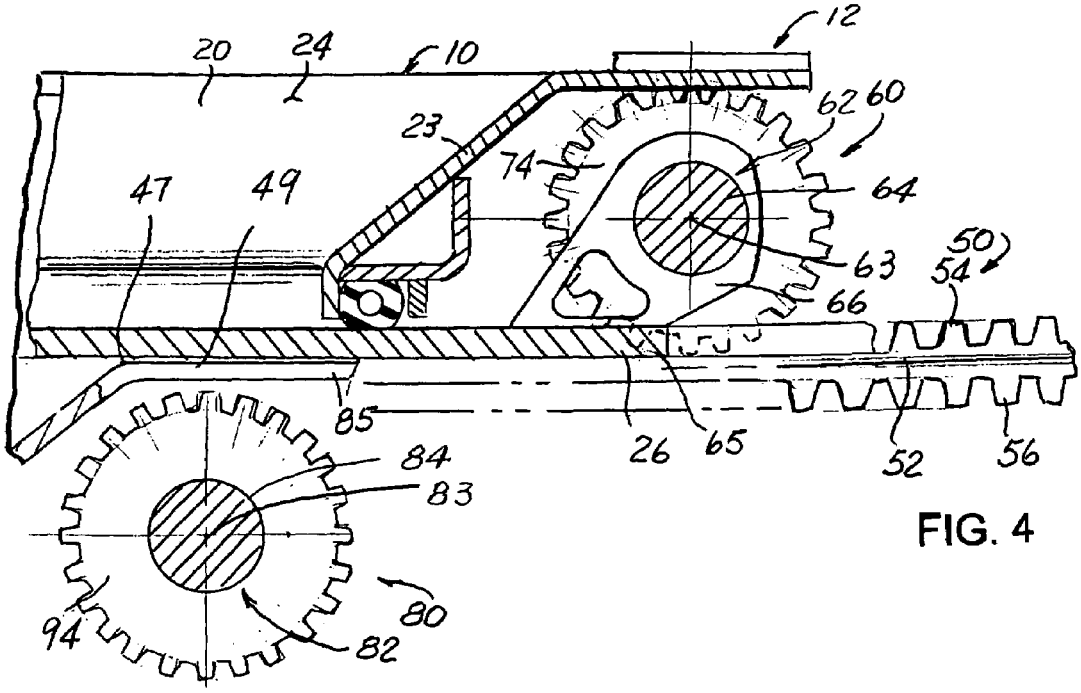
FIG. 4 is another fragmentary vertical transverse section showing, in detail, operating mechanisms for operably moving the first and second elements of the gate assembly between closed and open positions.

As shown in FIG. 1, the second element or pan assembly 36 used to pneumatically discharge lading, includes two generally vertical and parallel sidewalls 40, a slanting front wall 42, an oppositely slanting end wall 44, and a generally flat bottom 46. As shown in FIG. 2, upper edges of the sidewalls 40 are configured to form flanges 41 which, in the illustrated embodiment, are slidably supported on inwardly directed flange portions 21 provided beneath the path of travel of the sliding gate 26 toward a lower end of the sidewalls 20 of frame structure 18. In the illustrated embodiment, an upper edge 43 of the front wall 42 is configured with a flange 45 which, in the closed position of the second element 36, cooperates with the frame structure 18 to define a stop for limiting movement of element 36 from the open position toward the closed position. As known in the art, and as shown in FIG. 4, an upper edge 47 of the slanting end wall 44 is configured with a rearwardly extending, generally horizontal flange 49. Suitable gasket structure (not shown), provided between the flanges 45, 49 and the frame structure 18, creates a seal for inhibiting contaminants from passing between element 36 and the frame structure 18. When the second element 36 is formed as a pan assembly, a well known conduit system 48 is also provided in combination therewith to allow air of a pneumatic system to be used to entrain the lading in a conventional manner for discharge of same from the pneumatic chamber 38.

In one forms gate assembly 10 further includes rack structure 50 provided in combination with the frame structure 18. As shown in FIG. 3, a pair of transversely spaced longitudinal extensions 52 extend from the end wall 23 of frame structure 18 and operably serve as extensions of the sidewalls 20. In one form, each rigid extension 52 is generally Z-shaped in cross-section. In the embodiment illustrated in FIG. 3, each rigid extension 52 includes a generally horizontal and outwardly directed flange 53. The flange 53 of each extension carries and has secured thereto a toothed rack 54 on the upper face thereof and a toothed rack 56 on the lower face thereof. The extensions 52 are rigidly spaced apart toward their free outer ends by a transverse member 57 (FIG. 5) and toward their inner ends by the end wall 23 of frame structure 18.

As shown in FIG. 3, each extension 52 carries a longitudinal extensions of the gate supporting rails 28 thereon. Each rigid extension 52 further includes a bottom or lower flange 58 which, in effect, forms an extension of the flange portion 21 (FIG. 2) at the lower end of each sidewall 20 of the frame structure 18 and is adapted to slidably support the flanged upper edge 41 of the second element 36 when the second element 36 is moved away from the discharge opening 24 defined by frame structure 18.

A first drive mechanism 60 selectively and positively moves the first element or slide gate 26 between the closed and open positions relative to the discharge opening 24. In the illustrated embodiment, the first drive mechanism 60 includes an elongated operating shaft assembly 62 defining a first axis 63. In the embodiment illustrated in FIGS. 1, 3 and 4, the first operating shaft assembly 62 includes an elongated rotatable drive shaft 64 carried by and operably connected to a trailing edge 65 (FIG. 4) of the first element or gate 26 by a pair of brackets 66 which serve to journal shaft 64 for rotation about axis 63. Operating shaft assembly 62 further includes operating handles 67 operably connected to opposed ends of the shaft 64 whereby allowing drive mechanism 60 to be operated from either side of the railcar. Each handle 67 is configured to accommodate either an operating bar (not shown) or a conventional well known drive device for selectively rotation of shaft assembly 62. Additionally, a pair of pinion gears 74 are rigidly attached to the shaft 64 in transverse spaced relation relative to each other and in intermeshing relation with the upper racks 54 of rack structure 50. A stop 76 (FIG. 5), provided toward the distal end of each upper rack 54, limits movement of the drive mechanism 60 and thereby limits movement of the gate 26 away from the discharge opening 24 in the frame structure 18.

A second drive mechanism 80 selectively and positively moves the second element or pan assembly 36 between the closed and open positions relative to the discharge opening 24. In the illustrated embodiment, the second drive mechanism 80 includes an elongated operating shaft assembly 82 defining a second axis 83 extending generally parallel to axis 63 of shaft assembly 62. In the embodiment illustrated in FIG. 3, the second operating shaft assembly 82 includes an elongated rotatable drive shaft 84 carried by and operably connected to a trailing end 85 of the second element or pan assembly 36 by a pair of brackets 86 which serve to journal shaft 84 for rotation about axis 83. Operating shaft assembly 82 further includes operating handles 87 operably connected to opposed ends of the shaft 84 whereby allowing drive mechanism 80 to be operated from either side of the railcar. Each handle 87 is configured to accommodate either an operating bar (not shown) or a conventional well known drive device for selectively rotation of shaft assembly 82. Additionally, a pair of pinion gears 94 are rigidly attached to the shaft 84 in transversely spaced relation relative to each other and in intermeshing relation with the lower racks 56 of rack structure 50. A stop (not shown) limits movement of the drive mechanism 80 and thereby limits sliding movement of the second element or pan assembly 36 away from the discharge opening 24 in the frame structure 18.

According to the present invention, a lock assembly 100 is provided for inhibiting inadvertent sliding movement of either the first element 26 and/or second element 36 from the closed position toward the open position. Preferably, lock assembly 100 is designed as a kit allowing assembly 100 to be retrofitted to existing gate assemblies in the field. The lock assembly 100 of the present invention preferably provides one mechanism for ensuring both the first element 26 and second element 36 of the gate assembly 10 are inhibited from inadvertent movements from their closed toward their open positions. Moreover, the lock assembly 100 of the present invention is advantageously designed such that but a single motion is required for releasing the lock assembly 100 whereby allowing selective movement of either the first element or gate 26, the second element 36, or both.

Figure 5:
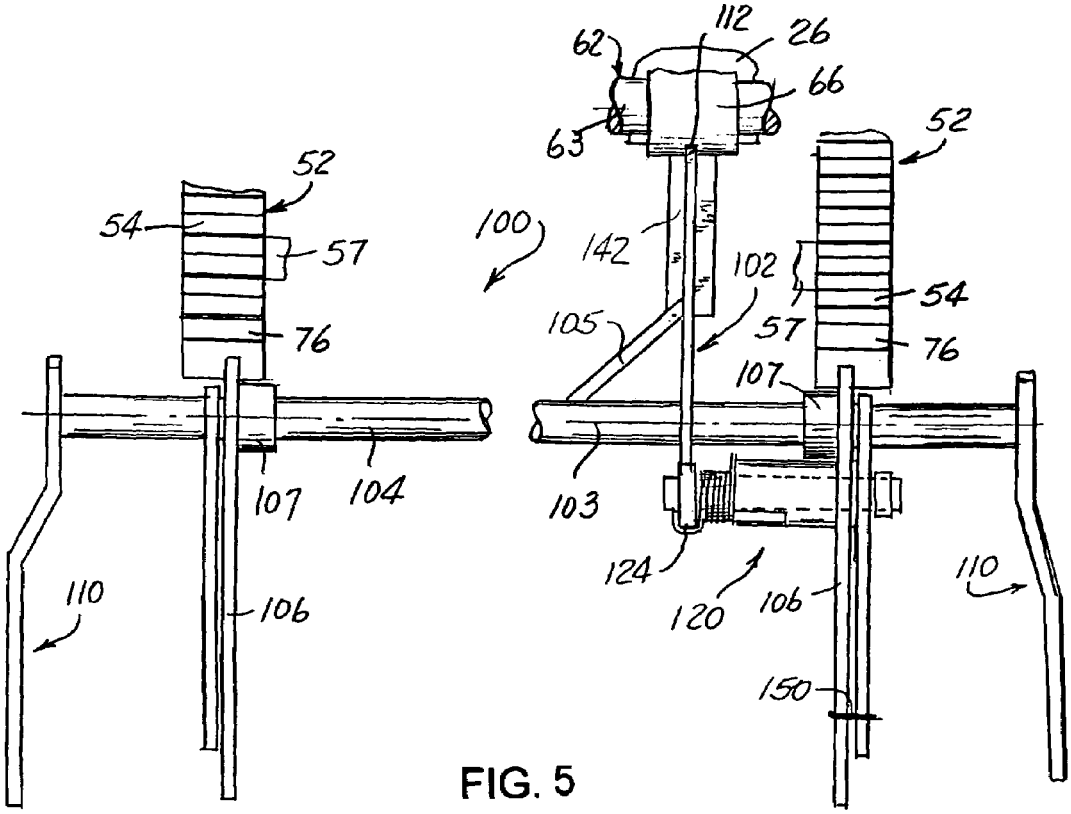
FIG. 5 is a top plan view of one form of lock assembly for a railroad hopper car gate assembly embodying principals of the present invention.

In a preferred form, lock assembly 100 includes an elongated locking member 102 arranged for movement between locking and unlocking conditions. In its locking condition, and as shown in FIGS. 5 and 6, locking member 102 extends into the path of travel of gate 26 to operably preventing movement of gate 26 from the closed position toward the open position. In a preferred form, and when in its locking condition, locking member or lever 102 likewise extends into the path of travel of the second element or pan assembly 36 to operably prevent its movement from the closed position toward the open position. It should be appreciated, lock assembly 100 could include more than one locking member or lever; with said locking members or levers operating in operable combination relative to each other The locking member 102 of lock assembly 100 is also selectively movable to an unlocking condition, shown in FIG. 7. In the unlocking condition, locking member 102 is conditioned to permit sliding movement of the gate 26 toward the open position from the closed position and relative to the discharge opening 24 in the gate assembly 10. In the preferred form, and after the locking member 102 is selectively moved to an unlocking condition, locking member 102 is also conditioned to permit sliding movement of the second element or pan assembly 36 toward the open position from the closed position relative to the discharge opening 24 in gate assembly 10.

Preferably, lock assembly 100 further includes a control shaft 104 mounted toward a free end of the extensions 52 of frame structure 18 for rotation about a fixed axis 103 extending generally parallel to the axis 63 of drive mechanism 60. In a preferred form, and for reasons explained below, axis 103 of lock assembly 100 is disposed above the upper surface 27 of slide gate 26. In the illustrated embodiment, the elongated control shaft 104 has a length defining a second predetermined distance which is greater than the first predetermined distance between the opposed sidewalls 20 of frame structure 18 (FIG. 1).

In the illustrated embodiment, and to facilitate retrofitting the lock assembly 100 as a kit to existing gate assemblies in the field, a pair of mounting brackets 106 are provided for rigid securement toward the free ends of the extensions 52 on the frame structure 18. As shown in FIGS. 1 and 5, the mounting brackets 106 are configured to journal the control shaft 104 between the opposed ends thereof and for rotation about axis 103, preferably disposed above the upper surface 27 of the sliding gate 26. In the illustrated embodiment, a pair of collars 107 or other conventional devices are axially spaced and secured along the length of the control shaft 104 and in abutting relationship to opposed inner sides of the mounting brackets 106 for limiting axial displacement of the control shaft 104 relative to the brackets 106.

Preferably, and as shown in FIG. 5, lock assembly 100 further includes operating handles 110 radially extending from and secured to opposed ends of the control shaft 104 so as to allow for operation of the lock assembly 100 from either side of the railcar. As will be appreciated, movements of a free end of either operating handle 110 translates into rocking or rotational movement of the control shaft 104 about axis 103. Intermediate their ends, each operating handle 110 is preferably provided with a transverse setoff which further facilitates operator access to the handles 110 from either side of the railcar. Moreover, and since control shaft 104 is configured with a predetermined distance greater than the predetermined width of the gate assembly 10, the transverse setoff of each operator handle 110 on the lock assembly 100 only furthermore promotes access to and operation of the lock assembly 100.

As shown in FIGS. 1, 5 through 7, a proximate end of each locking member 102 is secured to and for rotation with control shaft 104. Locking member 102 radially extends from the control shaft 104 and a distal or free end of locking member 102 preferably defines a vertical and arcuate cam surface 112. In the illustrated embodiment, and intermediate upper and lower ends thereof, the cam surface 112 extends into the path of travel of the gate 26 when locking member 102 in a locking condition. As shown in FIG. 5, a brace 105 can be provided between each locking lever or member 102 and control shaft 103 for adding strength and rigidity to each lever 102.

In the illustrated embodiment, and to simplify the locking mechanism 100 design when used in combination with a gate assembly having two vertically displaced and sliding elements 26 and 36, surface 112 of the locking member 102 has two peripheral faces generally identified by reference numerals 112*a* and 112*b* disposed at different radial distances from the axis 103 about which member 102 moves. With this design, an in standing shoulder or abutment 114 is provided on the locking member 102 between the two peripheral faces 112*a* and 112*b*. In the illustrated embodiment, and as shown in FIG. 6, with the locking member 102 disposed in a locking condition and the slide gate 26 and pan assembly 36 in their closed positions, the shoulder or abutment 114 rests or sits on the flange 49 of the pan assembly 36 whereby limiting vertical displacement of the locking member 102 in a clockwise direction as shown in FIG. 6.

As shown, and with the shoulder or abutment 114 resting or sitting on the flange 49, the peripheral face 112*b*of the locking member 102 extends into the path of travel of the pan assembly 36 thereby inhibiting inadvertent sliding movement of the pan assembly 36 from the closed position shown in FIG. 6. With the shoulder or abutment 114 resting or sitting on the flange 49, the remaining peripheral face 112*a* of the locking member 102 extends into the path of travel of the gate 26 thereby inhibiting inadvertent sliding movement of the pan assembly 36 from the closed position shown in FIG. 6. In the illustrated embodiment, and with the shoulder or abutment 114 resting or sitting on the flange 49, the locking member or lever 102 is preferably disposed along the length of the control shaft 104 such that the peripheral face 112*a* of the locking member 102 extends into a generally abutting relationship with at least one of the brackets 66 (FIG. 5) operably connecting the drive mechanism 60 with the sliding gate 26.

To inhibit the inadvertent return of the locking member or lever 102 from an unlocking condition (FIG. 7) and, thus, guard against potential damage to the lock assembly 100, lock assembly 100 furthermore includes a mechanism 120 for releasably maintaining the locking lever 102 in the unlocking condition until after the gate 26 has been moved a predetermined distance from the closed position toward the open position. As shown in FIG. 7, mechanism 120 preferably includes cam structure 122 secured to and for rotation with the control shaft 104 of assembly 100 and a follower latch 124. As shown, cam structure 120 is formed as an integral part of the locking lever 102. It should be appreciated, however, a cam member separate from the locking lever 102 and secured to the control shaft 104 could equally be used to effect the desired ends without detracting or departing from the spirit and scope of the present invention.

As shown in FIG. 6, cam structure 122 defines a plurality of cam portions 122*a* and 122*b* on the periphery thereof. As is apparent from comparing FIGS. 6 and 7, when the locking lever or stop 102 is in a locking condition (FIG. 6), and in one rotational position of the cam structure 122, the follower latch 124 is merely guided along the cam peripheral portion 122*a* and is operably disengaged from the cam structure 122. In response to the locking lever or stop 102 being moved to an unlocking condition, however, and as shown in FIG. 7, the follower latch 124 operably engages with cam peripheral portion 122*b* to prevent locking member or lever 102 from inadvertently returning to the locking condition.

Figure 8:
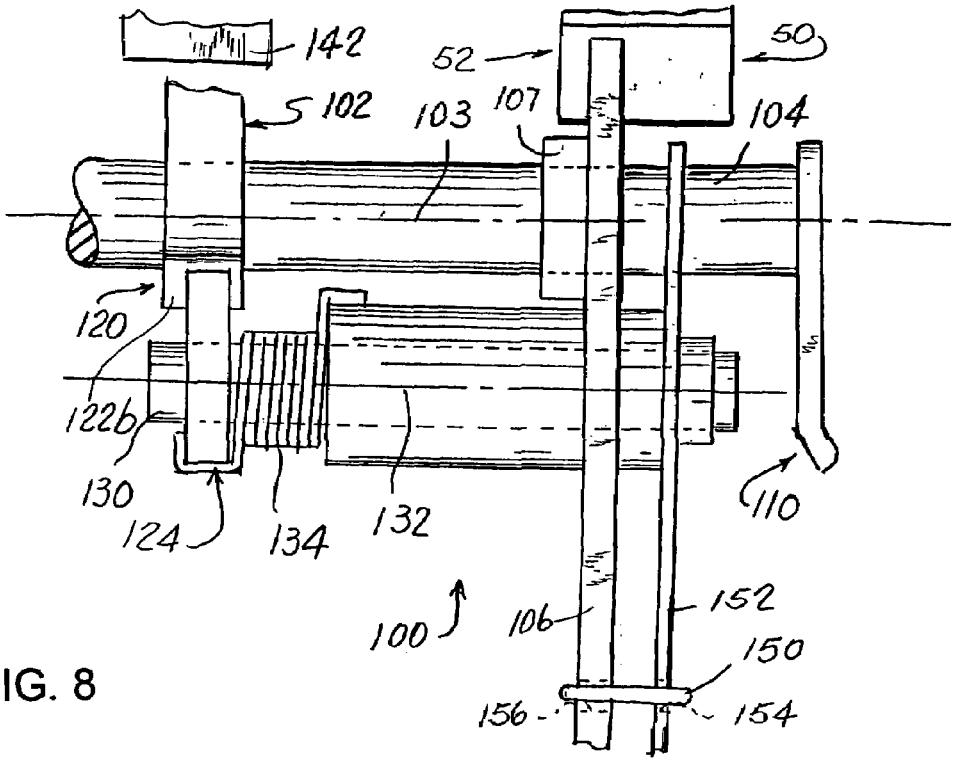
FIG. 8 is an enlarged top plan view of a latching mechanism forming part of the lock assembly of the present invention.

As shown in FIG. 8, one of the mounting brackets 106 of assembly 100 preferably supports a rockshaft 130 for rocking movement about a fixed axis 132 extending generally parallel to axis 103 of the control shaft 104. One end of the follower latch 124 is fixedly attached to the rockshaft 130 so as to allow for rocking movements of the free end of the follower latch 124. In the illustrated embodiment, a torsion spring 134, suitably fixed about the rockshaft 130, serves to bias the free end of the follower latch 124 into contact with a periphery of the cam structure 120 and, thus, effecting automatic engagement with the cam peripheral portion 122*b* after the locking member or lever 102 has been adequately rotated to the unlocking condition.

Figure 9:
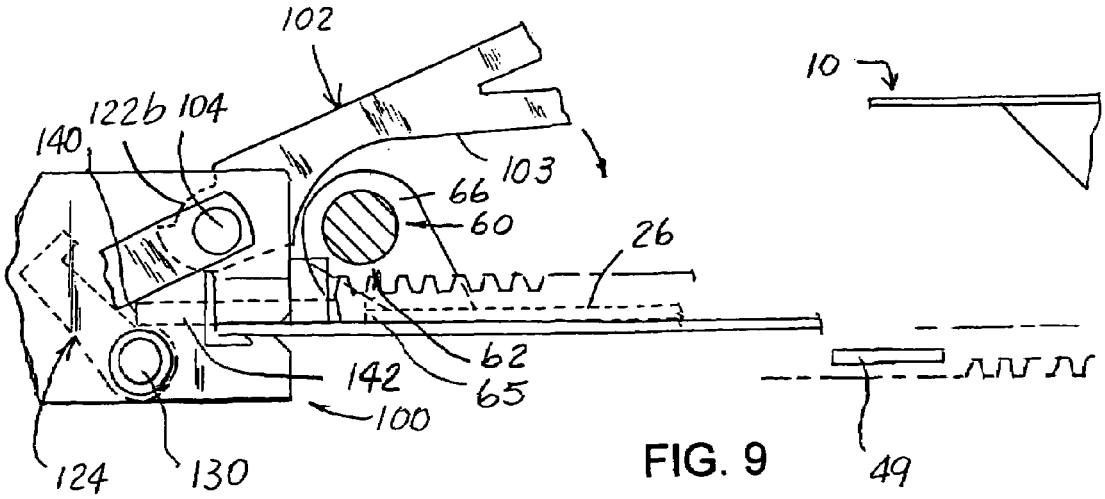
FIG. 9 is another view similar to FIG. 6 but showing the stop of the lock assembly after the first element or gate of the gate assembly is moved a predetermined distance toward an open position.

Turning to FIG. 9, after the first element or gate 26 of the gate assembly 10 has been linearly displaced a predetermined amount or distance toward the open position, an edge 140 on the gate 26 operably pushes against the follower latch 124 to cause the free end thereof to rotate in a counterclockwise direction (as seen in FIG. 9) against the bias of the spring 134 (FIG. 8), thus, causing the free end of the follower latch 124 to disengage from the cam structure 120. As will be appreciated, following disengagement of the follower latch 124 from the cam structure 120, and as seen in FIG. 9, the locking lever or member 102 is free to rotate in a clockwise direction and move toward its locking condition.

Preferably, mechanism 100 is designed such that when element 26 is linearly moved a sufficient distance to disengage the locked relationship between the follower latch 124 and the cam structure 120, element 26 has likewise been linearly displaced by a distance such that one of the brackets 66 used to operably couple drive mechanism 60 to the gate 26 operably engages a cammed undersurface 103 on the lock lever or stop 102 whereby maintaining the lock lever or stop 102 in close proximity to the unlocking condition. Suffice it to say, the undersurface 103 on the lock lever or stop 102 is preferably configured to allow for the gradual return of the lock lever or member 102 toward the locking condition as the gate 26 is returned toward the closed position relative to the discharge opening 24 (FIG. 1). In order to significantly reduce the quantity of material required for the gate 26 and, thus, significantly reduce the weight thereof, the edge 140 of the gate 26 operably engaging with the follower latch 124 is preferably defined by a relatively thin but rigid extension 142 extending from the trailing edge 65 of the gate 26.

Returning to FIGS. 5 and 8, a preferred form of the lock assembly 100 is configured with a tamper seal arrangement for accepting a fracturable or breakable seal 150 for providing a quick and visually identifiable indicator whether the gate or first element 26 has been moved toward an open position. In the embodiment illustrated in FIG. 8, the tamper seal arrangement involves providing the control shaft 104 with a lever 152 radially extending therefrom and in proximate, generally parallel relation with either of the mounting brackets 106. Both lever 152 and the adjacent mounting bracket are provided with bores 154 and 156, respectively, arranged in general registry relative to each other when the lock lever or stop 102 is in a locking condition and with each bore 154, 156 defining a closed margin. This tamper seal design or arrangement permits the seal 150 to be inserted through both openings or holes 154, 156 in a closed loop. As will be understood, seal 150 must be broken before the first element or gate 26 may be opened and the presence of an unbroken seal 150 visually indicates and signifies the contents of car 12 are intact.

In summary and with the first and second elements 26 and 36, respectively, of gate assembly 10 both arranged in their closed positions, as shown in FIG. 6, locking lever or stop 102 is in the position shown with the shoulder 114 of lever 102 resting on the generally horizontal flange 49 of element 36. As will be appreciated, with the locking lever 102 so disposed, surface 112 on locking lever 102 inhibits inadvertent linear movements of either element 26 or 36 from their closed position. Moreover, the seal arrangement 150 (FIG. 8) effectively and quickly indicates whether the lock assembly 100 has been tampered with prior to unloading at the intended destination. Additionally, and since the pivot axis 103 for the locking lever 102 is disposed above the upper surface of the gate 26, the relationship of the locking lever 102 relative to the gate 26 can be quickly and readily assessed.

When the lading is to be unloaded from the railcar, the seal 150 is automatically broken as through movements of either operating handle 110 from either side of the railcar. Designing the lock assembly 100 such that the operating handles 110 are disposed a greater predetermined distance apart than are the sidewalls 20 on the gate assembly frame structure 18 significantly improves access thereto for the operator charged with unlocking assembly 100. The transverse offset preferably associated with each operating handle 110 furthermore improves access thereto. Additionally, and since the lock assembly 100 is preferably mounted at the free ends of the rack structure 50, rather than immediately adjacent to the end wall 23 of the frame structure 18, greater spacial access is provided, thus, improving the ability to operate the lock assembly 100.

After the lock lever or member 102 is moved to an unlocking condition, and as shown in FIGS. 7 and 9, the locking surface 112 is removed from the path of travel of each slide element 26, 36 on the gate assembly 10. As will be appreciated from above, and as one or both of the operating handles 110 are manipulated to unlock assembly 100, the cam structure 122 and latch or follower member 124 of mechanism 120 automatically engage relative to each other under the influence of spring 134 to effectively and positively lock the stop lever 102 in an unlocking condition. As such, gate 26 can be driven through mechanism 60 toward an open position without concern over the lock 102 inadvertently returning to the locked condition as a result of car impacts or other factors which, heretofore, could have inadvertently caused a known gate locking device to return to a locked condition. With the gate or first element 26 having been moved to the open position, the lading can either be pneumatically unloaded from the pan assembly 36 or pan assembly 36 can be moved toward an open position, as through operation of mechanism 80 whereby permitting gravitational unloading of the lading.

After gate 26 is linearly slid a predetermined distance toward the open position, edge 140 of gate 26 operably pushes the follower member 124 out of operable engagement with the cam structure 120 whereby releasing the lock assembly 100. It is important to note, by the time the gate edge 140 effectively disengages the follower member 124 from operable engagement with the cam structure 120, the gate 26 has been moved a sufficient linear distance such that release of the locking lever 102 from the unlocking condition can no longer result in harm or damage to the lock assembly 100. Moreover, in a preferred embodiment, and once the locking lever 102 has been released from the unlocking condition, the undersurface 103 on the stop lever 102 maintains the lock lever or stop 102 in close proximity to the unlocking condition. With the locking lever 102 having been released from the unlocking condition, and after the first and second elements 26, 36, respectively, of the gate assembly 10 are returned to their closed positions, the lever 102 gravitationally returns to the locked condition to inhibit inadvertent linear displacement of the elements 26, 36 as the railcar moves between locations.

From the foregoing, it will be observed that numerous modifications and variations can be made and effected without departing or detracting from the true spirit and novel concept of the present invention. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed is:

1. A lock assembly kit having components capable of being assembled to a railroad car gate assembly including a rigid frame defining a discharge opening and having a pair of generally parallel racks arranged on opposite sides of said discharge opening, a gate mounted on said frame for sliding movements longitudinally between open and closed positions and relative to said discharge opening, and a drive mechanism arranged in operable combination with said racks for moving said gate between the open and closed positions, said lock assembly kit comprising:

a control shaft mounted for rotation about a fixed axis relative to said frame, with the fixed axis of said control shaft being disposed above an upper surface of said gate, and with said control shaft having operating handles radially extending from and secured to opposed ends thereof;

a stop secured axially intermediate the opposed ends of said control shaft for rotation with said control shaft, with a portion of said stop extending into the path of travel of the gate when said stop is in a locked condition; and a spring biased latching mechanism arranged adjacent said control shaft, with said latching mechanism operably engaging and positively holding said stop in an unlocked condition, wherein said stop is removed from the path of travel of the gate, until after said gate has been moved a predetermined distance toward the open position; wherein said spring biased latching mechanism is located longitudinally beyond parameters of said ante at all positions of said gate.

2. The lock assembly kit according to claim 1, wherein a tamper seal arrangement is provided for visually indicating whether said stop has been moved from said locked condition.

3. The lock assembly kit according to claim 1, wherein said spring biased latching mechanism including cam structure configured for rotation with said control shaft and a follower latch, with a periphery of said cam structure defining a plurality of portions, and with said stop being in said locked condition and in one rotation position of said cam structure, said follower latch is operably disengaged from said cam structure and, in response to said stop being moved to an unlocked condition, said follower latch operably engages with another portion of said cam structure whereby preventing said stop from returning to said locked condition.

4. The lock assembly kit according to claim 1, wherein the control shaft of said spring biased latching mechanism is disposed adjacent to a free end of said racks.

* * * * *